US011688544B2

(12) United States Patent
Hamada et al.

(10) Patent No.: US 11,688,544 B2
(45) Date of Patent: Jun. 27, 2023

(54) INDUCTOR COMPONENT

(71) Applicant: Murata Manufacturing Co., Ltd., Kyoto (JP)

(72) Inventors: Akinori Hamada, Nagaokakyo (JP); Shinji Yasuda, Nagaokakyo (JP); Yoshimasa Yoshioka, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 938 days.

(21) Appl. No.: 16/503,325

(22) Filed: Jul. 3, 2019

(65) Prior Publication Data

US 2020/0027646 A1 Jan. 23, 2020

(30) Foreign Application Priority Data

Jul. 17, 2018 (JP) ..... 2018-134187

(51) Int. Cl.

| | |
|---|---|
| ***H01F 5/00*** | (2006.01) |
| ***H01F 27/28*** | (2006.01) |
| ***H01F 27/255*** | (2006.01) |
| ***H01F 41/04*** | (2006.01) |
| ***H01F 41/12*** | (2006.01) |
| ***H01F 27/32*** | (2006.01) |

(52) U.S. Cl.

CPC ..... *H01F 27/2804* (2013.01); *H01F 27/255* (2013.01); *H01F 27/323* (2013.01); *H01F 41/041* (2013.01); *H01F 41/122* (2013.01); *H01F 2027/2809* (2013.01)

(58) Field of Classification Search

CPC ..... H01F 27/2804

USPC ..... 336/200

See application file for complete search history.

(56) References Cited

U.S. PATENT DOCUMENTS

| | | | | |
|---|---|---|---|---|
| 10,014,102 | B2 | 7/2018 | Choi et al. | |
| 10,453,602 | B2 | 10/2019 | Yoshioka et al. | |
| 2001/0024739 | A1 | 9/2001 | Mizoguchi et al. | |
| 2009/0045905 | A1* | 2/2009 | Nakagawa | H01F 17/0006 336/232 |
| 2010/0176909 | A1 | 7/2010 | Yasuda et al. | |
| 2014/0022041 | A1 | 1/2014 | Park et al. | |
| 2014/0139309 | A1* | 5/2014 | Son | H01F 17/0013 336/200 |

(Continued)

FOREIGN PATENT DOCUMENTS

| | | |
|---|---|---|
| JP | 2001-244123 A | 9/2001 |
| JP | 2001-244124 A | 9/2001 |

(Continued)

OTHER PUBLICATIONS

English translation of JP2003017322 (Year: 2003).*

(Continued)

*Primary Examiner* — Ronald Hinson

(74) *Attorney, Agent, or Firm* — Studebaker & Brackett PC

(57) ABSTRACT

An inductor component comprising a first magnetic layer, a spiral wiring disposed on the first magnetic layer, and a second magnetic layer covering the spiral wiring. The first magnetic layer and the second magnetic layer contain a magnetic powder and a resin containing the magnetic powder, and the spiral wiring includes a spiral-shaped first conductor layer and a second conductor layer disposed on the first conductor layer and shaped along the first conductor layer.

20 Claims, 9 Drawing Sheets

(56) References Cited

U.S. PATENT DOCUMENTS

| | | | | |
|---|---|---|---|---|
| 2014/0313005 | A1* | 10/2014 | Bang | H01F 27/292 336/200 |
| 2015/0035634 | A1* | 2/2015 | Nakamura | H01F 41/046 336/170 |
| 2015/0170823 | A1* | 6/2015 | Jeong | C25D 7/001 336/200 |
| 2016/0247624 | A1 | 8/2016 | Seo et al. | |
| 2017/0098997 | A1* | 4/2017 | Hamada | H01F 1/0306 |
| 2018/0197672 | A1* | 7/2018 | Kim | H01F 41/125 |

FOREIGN PATENT DOCUMENTS

| | | | |
|---|---|---|---|
| JP | 2005-064074 | A | 3/2005 |
| JP | 2010-027758 | A | 2/2010 |
| JP | 2012-169597 | A | 9/2012 |
| JP | 2013-225718 | A | 10/2013 |
| JP | 2014-022724 | A | 2/2014 |
| JP | 2015-076603 | A | 4/2015 |
| JP | 2016-146431 | A | 8/2016 |
| JP | 2017-199801 | A | 11/2017 |
| JP | 2018-046051 | A | 3/2018 |

OTHER PUBLICATIONS

An Office Action; "Notice of Reasons for Refusal," mailed by the Japanese Patent Office dated Sep. 14, 2021, which corresponds to Japanese Patent Application No. 2018-134187 and is related to U.S. Appl. No. 16/503,325 with English translation.

An Office Action; "Notice of Reasons for Refusal," mailed by the Japanese Patent Office dated Feb. 9, 2021, which corresponds to Japanese Patent Application No. 2018-134187 and is related to U.S. Appl. No. 16/503,325 with English language translation.

* cited by examiner

INDUCTOR COMPONENT

CROSS REFERENCE TO RELAYED APPLICATION

This application claims benefit of priority to Japanese Patent Application 2018-134187 filed Jul. 17, 2018, the entire content of which is incorporated herein by reference.

BACKGROUND

Technical Field

The present disclosure relates to an inductor component.

Background Art

A conventional inductor component is described in Japanese Laid-Open Patent Publication No. 2013-225718. This inductor component includes an insulating substrate, a spiral conductor formed on a principal surface of the insulating substrate, an insulating layer containing no magnetic substance covering the spiral conductor, and an upper magnetic layer and a lower magnetic layer covering the upper-surface side and the back-surface side of the insulating substrate and made of a resin containing a magnetic powder.

SUMMARY

In Japanese Laid-Open Patent Publication No. 2013-225718, since the insulating layer entirely covers the spiral conductor, a large region is occupied by the insulating layer with respect to the inductor component. The insulating layer contains no magnetic powder and has a lower magnetic permeability than the magnetic layers, which makes it difficult to improve inductance.

In Japanese Laid-Open Patent Publication No. 2013-225718, since the spiral conductor is formed on both surfaces of the insulating substrate, the insulating substrate cannot be processed after the spiral conductor is formed. Therefore, when the thickness of the insulating substrate (specifically 0.3 mm) is ensured for stably forming a laminated object such as the spiral conductor, this makes it difficult to reduce a height of an inductor component, and on the other hand, if the insulating substrate has a thickness allowing a reduction in height of the inductor component, this makes it difficult to stably form a laminated object such as the spiral conductor.

Therefore, the present disclosure provides an inductor component capable of improving an inductance while achieving a height reduction.

An aspect of the present disclosure provides an inductor component comprising a first magnetic layer, a spiral wiring disposed on the first magnetic layer, and a second magnetic layer covering the spiral wiring. The first magnetic layer and the second magnetic layer contain a magnetic powder and a resin containing the magnetic powder, and wherein the spiral wiring includes a spiral-shaped first conductor layer and a second conductor layer disposed on the first conductor layer and shaped along the first conductor layer.

According to the inductor component of the present disclosure, since the spiral wiring is directly disposed on the first magnetic layer, the inductor component can be reduced in height when the same inductance is acquired, and a larger inductance can be acquired from the same external shape. Since the first conductor layer protects the first magnetic layer immediately below, the influence on the first magnetic layer can be reduced when the second conductor layer is formed. Since the spiral wiring includes two layers, i.e., the first conductor layer and the second conductor layer, the inductor component with a high aspect ratio and a low electric resistance to a high frequency current can be achieved. The spiral wiring or the spiral shape means a curve (two-dimensional curve) extending on a plane, may be a curve having the number of turns exceeding one or may be a curve having the number of turns less than one, or may have a portion that is a straight line.

In an embodiment of the inductor component, the thickness of the second conductor layer is larger than the thickness of the first conductor layer.

Generally, the second conductor layer formed on the first conductor layer, i.e., a conductor layer formed on the same material, can be formed more stably and at lower cost as compared to the first conductor layer formed on the first magnetic layer, i.e., a conductor layer formed on a different material. Therefore, by increasing the ratio of the second conductor layer that can be formed stably and at lower cost in the spiral wiring, the inductor component can be improved in formation accuracy and reduced in price.

In an embodiment of the inductor component, a main material of the first conductor layer and the second conductor layer is Cu or an alloy containing Cu. According to the embodiment, the DC electrical resistance (Rdc) of the spiral wiring is reduced.

In an embodiment of the inductor component, a difference between the electric conductivity of the first conductor layer and the electric conductivity of the second conductor layer is 5% or less. According to the embodiment, the difference between the electric conductivity of the first conductor layer and the electric conductivity of the second conductor layer is small, and the current flowing through the spiral wiring flows substantially uniformly in cross sections of the first conductor layer and the second conductor layer, so that heat generation can be made uniform in the spiral wiring. Additionally, Rdc of the spiral wiring is reduced.

In an embodiment of the inductor component, the first conductor layer has a thickness of 0.5 μm or more. According to the embodiment, the unevenness of the first magnetic layer can be absorbed by the thickness of the first conductor layer, and the formation and processing of the second conductor layer are facilitated, so that the formation accuracy of the inductor component is improved.

In an embodiment of the inductor component, the Ni content percentages of the first conductor layer and the second conductor layer are substantially the same. According to the embodiment, a difference can be reduced between the electric conductivity of the first conductor layer and the electric conductivity of the second conductor layer, and the current flowing through the spiral wiring flows substantially uniformly in cross sections of the first conductor layer and the second conductor layer, so that heat generation can be made uniform in the spiral wiring. Additionally, Rdc of the spiral wiring is reduced.

In an embodiment of the inductor component, the first conductor layer has a Ni content percentage of 5.0 wt % or less. According to the embodiment, a difference can be reduced between the electric conductivity of the first conductor layer and the electric conductivity of the second conductor layer, and the current flowing through the spiral wiring flows substantially uniformly in cross sections of the first conductor layer and the second conductor layer, so that heat generation can be made uniform in the spiral wiring. Additionally, Rdc of the spiral wiring is reduced.

In an embodiment of the inductor component, the line width of the first conductor layer is different from the line width of the second conductor layer. According to the embodiment, a degree of design freedom of the spiral wiring is increased.

In an embodiment of the inductor component, the line width of the first conductor layer is larger than the line width of the second conductor layer. According to the embodiment, the spiral wiring has a forward tapered shape widened on the bottom side and narrowed on the top side, so that the second magnetic layer is easily filled in the vicinity of the side surfaces of the spiral wiring.

In an embodiment of the inductor component, a taper angle of a side surface of the first conductor layer is larger than a taper angle of a side surface of the second conductor layer. According to the embodiment, the spiral wiring has a forward tapered shape widened on the bottom side and narrowed on the top side, so that the second magnetic layer is easily filled in the vicinity of the side surfaces of the spiral wiring.

In an embodiment of the inductor component, the density of the magnetic powder is different between a portion of the first magnetic layer in contact with a bottom surface of the first conductor layer and a portion of the second magnetic layer in contact with the side surface of the first conductor layer. According to the embodiment, a degree of design freedom of the inductor component including the insulation and inductance of the spiral wiring is increased due to the density of the magnetic powder.

In an embodiment of the inductor component, the density of the magnetic powder in a portion of the first magnetic layer in contact with the bottom surface of the first conductor layer is higher than the density of the magnetic powder in a portion of the second magnetic layer in contact with the side surface of the first conductor layer. According to the embodiment, the effective magnetic permeability is improved on the bottom surface of the first conductor layer, and the insulation is improved on the side surface of the first conductor layer.

In an embodiment of the inductor component, the magnetic powder is in contact with a side surface of the spiral wiring. According to the embodiment, a filling amount of the magnetic powder into the second magnetic layer can be increased, and the inductance can be improved.

In an embodiment of the inductor component, the magnetic powder is in contact with a bottom surface of the spiral wiring. According to the embodiment, a filling amount of the magnetic powder into the first magnetic layer can be increased, and the inductance can be improved.

In an embodiment of the inductor component, the inductor component comprises a second spiral wiring adjacent to the spiral wiring on the same plane as the spiral wiring. According to the embodiment, an inductor array or an improvement in the inductance can be achieved.

In an embodiment of the inductor component, the inductor component further comprises an insulating layer disposed between the spiral wiring and the second spiral wiring and containing no magnetic substance, the spiral wiring includes a first side surface facing the second spiral wiring, and the first side surface is at least partially in contact with the second magnetic layer. According to the embodiment, since the first side surface is at least partially in contact with the second magnetic layer between the spiral wiring and the second spiral wiring improved in insulation due to the insulating layer disposed therebetween, the region of the second magnetic layer is increased, so that the inductance can effectively be improved while the insulation is ensured.

In an embodiment of the inductor component, the resin of the first magnetic layer and the second magnetic layer is epoxy, or a mixture of epoxy and acrylic, or a mixture of epoxy, acrylic, and another resin. According to the embodiment, since the insulation among particles of the metal magnetic powder of the first magnetic layer and the second magnetic layer can be ensured, an iron loss at high frequency can be made smaller.

In an embodiment of the inductor component, the spiral wiring includes an exposed portion exposed to the outside from a side surface parallel to a lamination direction of the inductor component. According to the embodiment, since the spiral wiring has the exposed portion, a resistance to electrostatic destruction can be improved at the time of manufacturing.

In an embodiment of the inductor component, the first magnetic layer includes a magnetic resin layer made of the magnetic powder and the resin, and a substrate that is a magnetic body made up of a sintered body having a first principal surface in close contact with the magnetic resin layer and a second principal surface above which the second magnetic layer is disposed. The spiral wiring is disposed between the second magnetic layer and the substrate.

As used herein, the phrase "in close contact" refers to a configuration in which constituent elements are in contact with each other without another constituent element interposed therebetween and, for example, in the above description, refers to a configuration in which the first principal surface of the substrate is in direct contact with the magnetic resin layer. Additionally, the term "above" refers to a configuration in which one of the constituent elements is located on the upper side, including both the case that the constituent elements are in close contact with each other as described above and the case that the constituent elements are not in close contact with each other and have another constituent element interposed therebetween, and, for example, in the above description, the second principal surface may be in direct contact with the second magnetic layer or another constituent element may be interposed between the second principal surface and the second magnetic layer.

According to the embodiment, laminated objects such as the second magnetic layer and the spiral wiring can be formed on the second principal surface of the stable substrate that is a sintered body, and therefore, the formation accuracy of the laminated objects can be improved. Since the first principal surface of the substrate is in close contact with the first magnetic layer, the spiral wiring is not formed on the first principal surface. Therefore, even if the thickness of the substrate is ensured to some extent so as to improve the formation accuracy of the laminated objects, the substrate can be processed by polishing etc. from the first principal surface side, so that the thickness can be reduced after the laminated objects are formed on the second principal surface. Therefore, both the formation accuracy and the height reduction of the inductor component can be achieved.

Additionally, since the substrate is not completely removed, the laminated objects such as the spiral wiring can be protected from the processing, and mass-production variations in Rdc etc. can be suppressed.

Furthermore, by adding a processing amount of the substrate as an adjustment element to a manufacturing process, a degree of design freedom can be improved in terms of the strength, inductance, height dimension, etc. of the inductor component, and the mass-production variations thereof can be reduced.

In an embodiment of the inductor component, the thickness of the magnetic resin layer and the thickness of the second magnetic layer are both larger than the thickness of the substrate. According to the embodiment, since the proportion of the magnetic resin layer and the second magnetic layer containing a relatively soft resin becomes larger, the stress absorbability of the inductor component is further improved, and an influence of thermal shock, external pressure, etc. can be reduced, so that the reliability of the inductor component 1 is further improved. Additionally, if the magnetic resin layer and the second magnetic layer contain the metal magnetic powder, the DC superimposition characteristics of the inductor component can be improved.

According to the inductor component of an aspect of the present disclosure, the inductance can be improved while a height reduction is achieved.

DETAILED DESCRIPTION

A surface-mount inductor of an aspect of the present disclosure will now be described in detail with reference to shown embodiments. The drawings include schematics and may not reflect actual dimensions or ratios.

First Embodiment (Configuration)

Figure 1A:
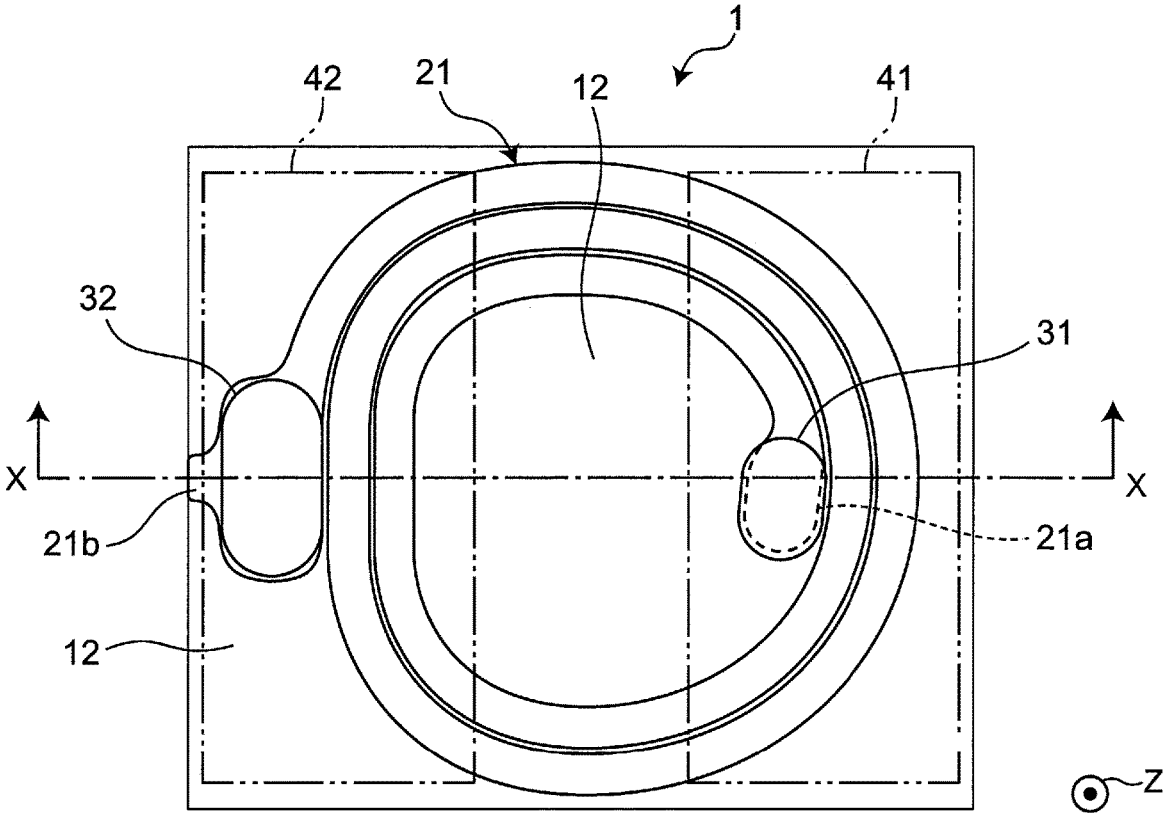
FIG. 1A is a transparent plan view showing an inductor component according to a first embodiment.
Figure 1B:
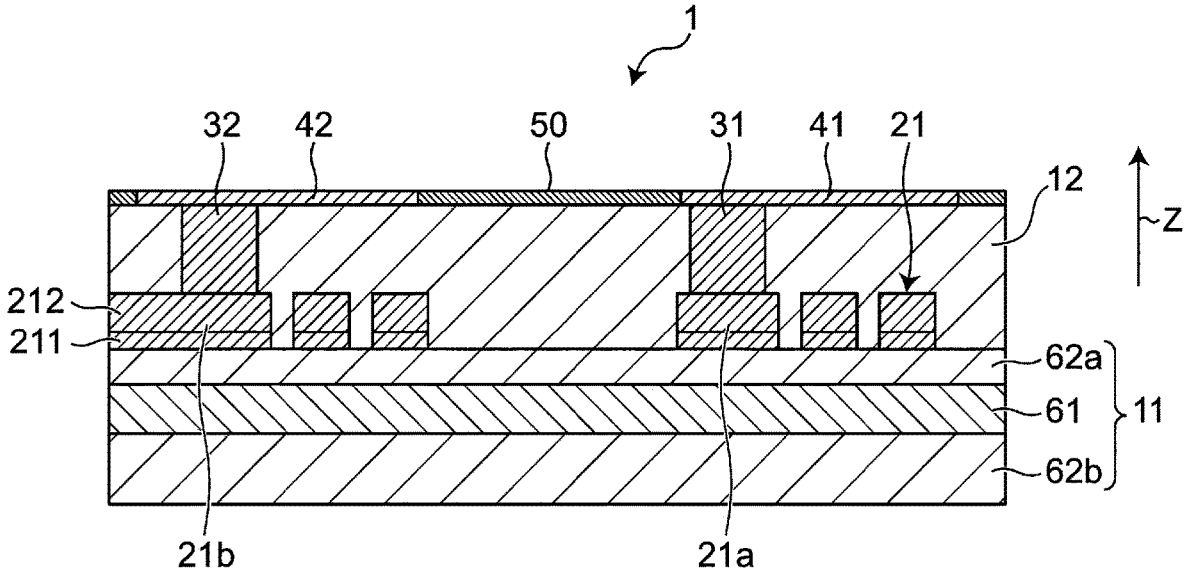
FIG. 1B is a cross-sectional view taken along a line X-X of FIG. 1A.

FIG. 1A is a transparent plan view showing a first embodiment of an inductor component. FIG. 1B is a cross-sectional view taken along a line X-X of FIG. 1A.

An inductor component 1 is mounted on an electronic device such as a personal computer, a DVD player, a digital camera, a TV, a portable telephone, a smartphone, and automotive electronics, for example, and is a component generally having a rectangular parallelepiped shape, for example. However, the shape of the inductor component 1 is not particularly limited and may be a circular columnar shape, a polygonal columnar shape, a truncated cone shape, or a truncated polygonal pyramid shape.

As shown in FIGS. 1A and 1B, the inductor component 1 includes a first magnetic layer 11, a second magnetic layer 12, a spiral wiring 21, columnar wirings 31, 32, external terminals 41, 42, and a coating film 50.

The first magnetic layer 11 has magnetic resin layers 62*a*, 62*b* made of a magnetic powder and a resin containing the magnetic powder, and a substrate 61 that is a magnetic body made up of a sintered body having a first principal surface 61*a* and a second principal surface 61*b* in close contact with the magnetic resin layers 62*b*, 62*a*, respectively, and the second magnetic layer 12 is disposed above the second principal surface. The substrate 61 has a flat plate shape and is a portion serving as a base for a manufacturing process of the inductor component 1. The substrate 61 includes the first principal surface 61*a* as a bottom surface and the second principal surface 61*b* as an upper surface. A normal direction relative to the principal surfaces 61*a*, 61*b* is defined as a Z direction (up-down direction) in the figures, and in the following description, it is assumed that a forward Z direction from the first principal surface 61*a* to the second principal surface 61*b* faces toward the upper side while a reverse Z direction from the second principal surface 61*b* to the first principal surface 61*a* faces toward the lower side. The Z direction is the same in the other embodiments and examples.

The substrate 61 is polished on the first principal surface 61*a* side, and the thickness of the substrate 61 is 5 μm or more and 100 μm or less (i.e., from 5 μm to 100 μm), for example. The substrate 61 is a magnetic substrate made up of a sintered body of a magnetic substance such as NiZn- or MnZn-based ferrite, for example. As a result, the strength and flatness of the substrate 61 can be ensured, and a workability of a laminated object on the substrate 61 is improved. However, the substrate 61 and one of the magnetic resin layers 62*a*, 62*b* are not an essential constituent element and, for example, the first magnetic layer 11 may have a configuration including only one of the magnetic resin layer 62*a* and the magnetic resin layer 62*b* or may have a configuration including two of the magnetic resin layer 62*a*, the magnetic resin layer 62*b*, and the substrate 61.

The second magnetic layer 12 is disposed above the first magnetic layer 11 (the second principal surface 61*b* of the substrate 61), or more specifically, on the magnetic resin layer 62*a*. The spiral wiring 21 is disposed on the first magnetic layer 11, and the second magnetic layer 12 covers the spiral wiring 21, so that the spiral wiring 21 is disposed between the second magnetic layer 12 and the substrate 61. The first magnetic layer 11 (the magnetic resin layers 62*a*, 62*b*) and the second magnetic layer 12 contain a magnetic powder that is a powder of a magnetic material and a resin containing the magnetic powder. The magnetic powder is, for example, a powder of metal magnetic material including an FeSi alloy such as FeSiCr, an FeCo alloy, an Fe alloy such as NiFe, or an amorphous alloy thereof, or a powder of NiZn- or MnZn-based ferrite etc. The content percentage of the magnetic powder is preferably 50 vol % or more and 85 vol % or less (i.e., from 50 vol % to 85 vol %) relative to the whole magnetic layer. The magnetic powder preferably has particles of substantially spherical shape, and the average particle diameter is preferably 5 μm or less. The resin is, for example, an epoxy resin, a phenol resin, a polyimide resin, an acrylic resin, a phenol resin, a vinyl ether resin, and a mixture thereof. Particularly, the resin is preferably epoxy, or a mixture of epoxy and acrylic, or a mixture of epoxy, acrylic, and another resin, and since the insulation among particles of the metal magnetic powder of the first magnetic layer and the second magnetic layer can be ensured, an iron loss at high frequency can be made smaller.

In the inductor component 1, laminated objects such as the second magnetic layer 12 and the spiral wiring 21 above the second principal surface 61*b* can be formed above the second principal surface 61*b* of the stable substrate 61 that is a sintered body, and therefore, the formation accuracy of the laminated objects can be improved. Since the first principal surface 61*a* is in close contact with the magnetic resin layer 62*b*, the spiral wiring 21 is not formed on the first principal surface 61*a*. As a result, even if the thickness of the substrate 61 is ensured to some extent so as to improve the formation accuracy of the laminated objects, the substrate 61 can be processed by polishing etc. from the first principal surface 61*a* side, so that the thickness can be reduced after the laminated objects are formed on the second principal surface 61*b*. Therefore, both the formation accuracy and the height reduction of the inductor component 1 can be achieved.

Additionally, since the substrate 61 is not completely removed, the laminated objects such as the spiral wiring 21 and the second magnetic layer 12 can be protected from the processing, and mass-production variations in Rdc etc. can be suppressed.

Furthermore, by adding a processing amount of the substrate 61 as an adjustment element to a manufacturing process, a degree of design freedom can be improved in terms of the strength, inductance, height dimension, etc. of the inductor component 1, and the mass-production variations thereof can be reduced.

Preferably, the thickness of the magnetic resin layer 62*b* and the thickness of the second magnetic layer 12 are both larger than the thickness of the substrate 61. As a result, since the proportion of the magnetic resin layer 62*b* and the second magnetic layer 12 containing a relatively soft resin becomes larger, the stress absorbability of the inductor component 1 is further improved, and an influence of thermal shock, external pressure, etc. can be reduced, so that the reliability of the inductor component 1 is further improved. Additionally, if the first magnetic layer 11 (the magnetic resin layers 62*a*, 62*b*) and the second magnetic layer 12 contain the metal magnetic powder, the DC superimposition characteristics of the inductor component 1 can be improved.

The spiral wiring 21 is formed only on the upper side of the substrate 61, or specifically, on the magnetic resin layer 62*a* on the second principal surface 61*b* of the substrate 61, i.e., in close contact with an upper surface of the magnetic resin layer 62*a*. The spiral wiring 21 is a wiring extending in a spiral shape along the second principal surface 61*b* of the substrate 61. The spiral wiring 21 has a spiral shape with the number of turns exceeding one. The spiral wiring 21 is spirally wound in a clockwise direction from an outer circumferential end 21*b* toward an inner circumferential end 21*a* when viewed from the upper side, for example.

The thickness of the spiral wiring 21 is preferably 40 μm or more and 120 μm or less (i.e., from 40 μm to 120 μm), for example. An example of the spiral wiring 21 has a thickness of 45 μm, a wiring width of 50 μm, and an inter-wiring space of 10 μm. The inter-wiring space is preferably 3 μm or more and 20 μm or less (i.e., from 3 μm to 20 μm).

The spiral wiring 21 is made of a conductive material and is made of a metal material having a low electric resistance such as Cu, Ag, and Au, for example. In this embodiment, the inductor component 1 includes only one layer of the spiral wiring 21, so that the inductor component 1 can be reduced in height. Specifically, the spiral wiring 21 has both ends (the inner circumferential end 21*a* and the outer circumferential end 21*b*) provided with pad portions having a line width slightly larger than a spiral-shaped portion and is directly connected at the pad portions to the columnar wirings 31, 32.

The columnar wirings 31, 32 are made of a conductive material, extend from the spiral wiring 21 in the Z direction, and penetrate the inside of the second magnetic layer 12. The first columnar wiring 31 extends upward from an upper surface of the inner circumferential end 21*a* of the spiral wiring 21. The second columnar wiring 32 extends upward from an upper surface of the outer circumferential end 21*b* of the spiral wiring 21. The columnar wirings 31, 32 are made of the same material as the spiral wiring 21.

The external terminals 41, 42 are made of a conductive material and has, for example, a three-layer configuration with Cu having low electric resistance and excellent in stress resistance, Ni excellent in corrosion resistance, and Au excellent in solder wettability and reliability arranged in this order from the inside to the outside.

The first external terminal 41 is disposed on an upper surface of the second magnetic layer 12 and is connected to the inner circumferential end 21*a* of the spiral wiring 21 to cover an end surface of the first columnar wiring 31 exposed from the upper surface. As a result, the first external terminal 41 is electrically connected to the inner circumferential end

21*a* of the spiral wiring 21. The second external terminal 42 is disposed on an upper surface of the second magnetic layer 12 and is connected to the outer circumferential end 21*b* of the spiral wiring 21 to cover an end surface of the second columnar wiring 32 exposed from the upper surface. As a result, the second external terminal 42 is electrically connected to the outer circumferential end 21*b* of the spiral wiring 21.

Preferably, a rust prevention treatment is applied to the external terminals 41, 42. This rust prevention treatment refers to coating with Ni and Au, or Ni and Sn, etc. This enables the suppression of copper leaching due to solder and the rusting so that the inductor component 1 with high mounting reliability can be provided.

The coating film 50 is made of an insulating material and covers the upper surface of the second magnetic layer 12 to expose the end surfaces of the columnar wirings 31, 32 and the external terminals 41, 42. With the coating film 50, the insulation of the surface of the inductor component 1 can be ensured. The coating film 50 may be formed on the bottom side of the first magnetic layer 11.

The spiral wiring 21 disposed on the first magnetic layer 11 has a spiral-shaped first conductor layer 211 and a second conductor layer 212 disposed on the first conductor layer 211 and shaped along the first conductor layer 211. As a result, since the spiral wiring 21 is directly disposed on the first magnetic layer 11, the inductor component 1 can be reduced in height when the same inductance is acquired, and a larger inductance can be acquired from the same external shape. Since the first conductor layer 211 protects the first magnetic layer 11 immediately below, the influence on the first magnetic layer 11 can be reduced when the second conductor layer 212 is formed. Since the spiral wiring 21 includes two layers, i.e., the first conductor layer 211 and the second conductor layer 212, the inductor component 1 with a high aspect ratio and a low electric resistance to a high frequency current can be achieved.

The thickness of the second conductor layer 212 is larger than the thickness of the first conductor layer 211. Generally, the second conductor layer 212 formed on the first conductor layer 211, i.e., a conductor layer formed on the same material, can be formed more stably and at lower cost as compared to the first conductor layer 211 formed on the first magnetic layer 11, i.e., a conductor layer formed on a different material. Therefore, by increasing the ratio of the second conductor layer 212 that can be formed stably and at lower cost in the spiral wiring 21, the inductor component 1 can be improved in formation accuracy and reduced in price.

A main material of the first conductor layer 211 and the second conductor layer 212 is preferably Cu or an alloy containing Cu. As a result, Rdc of the spiral wiring 21 is reduced.

A difference between the electric conductivity of the first conductor layer 211 and the electric conductivity of the second conductor layer 212 is preferably 5% or less. As a result, the difference between the electric conductivity of the first conductor layer 211 and the electric conductivity of the second conductor layer 212 is small, and the current flowing through the spiral wiring 21 flows substantially uniformly in cross sections of the first conductor layer 211 and the second conductor layer 212, so that heat generation can be made uniform in the spiral wiring 21. Additionally, Rdc of the spiral wiring 21 is reduced.

The thickness of the first conductor layer 211 is preferably 0.5 μm or more. As a result, the unevenness of the first magnetic layer 11 can be absorbed by the thickness of the first conductor layer 211, and the formation and processing of the second conductor layer 212 are facilitated, so that the formation accuracy of the inductor component 1 is improved. In this case, it can be said that the first conductor layer is not formed by electroless plating or sputtering.

The Ni content percentages of the first conductor layer 211 and the second conductor layer 212 are preferably substantially the same. As a result, a difference can be reduced between the electric conductivity of the first conductor layer 211 and the electric conductivity of the second conductor layer 212, and the current flowing through the spiral wiring 21 flows substantially uniformly in cross sections of the first conductor layer 211 and the second conductor layer 212, so that heat generation can be made uniform in the spiral wiring 21. Additionally, Rdc of the spiral wiring 21 is reduced. In this case, it can be said that the first conductor layer 211 is not formed by electroless plating.

Preferably, the Ni content percentage of the first conductor layer 211 is 5.0 wt % or less. As a result, a difference can be reduced between the electric conductivity of the first conductor layer 211 and the electric conductivity of the second conductor layer 212, and the current flowing through the spiral wiring 21 flows substantially uniformly in cross sections of the first conductor layer 211 and the second conductor layer 212, so that heat generation can be made uniform in the spiral wiring 21. Additionally, Rdc of the spiral wiring 21 is reduced. In this case, it can be said that the first conductor layer 211 is not formed by electroless plating.

As described above, if the first conductor layer 211 is not formed by electroless plating, the first magnetic layer 11 can be prevented from being affected by a process of applying a catalyst to the first magnetic layer 11, an electroless plating process (a seed layer forming step), and a process of etching a conductor layer formed by electroless plating (a seed layer removing step). Specifically, the magnetic resin layer 62*a* of the first magnetic layer 11 contains a magnetic powder, and the magnetic powder can be restrained from being removed by a plating solution, an etching solution, etc. used in a pretreatment or a process at the time of formation of the first conductor layer 211. Therefore, as described above, if the first conductor layer 211 has a feature that the layer is not formed by electroless plating, the first magnetic layer 11 can be prevented from decreasing in magnetic permeability and decreasing in strength.

In a method of measuring the Ni content percentage, after performing a pretreatment for making a boundary between the first conductor layer and the second conductor layer clear as needed, the Ni content percentage (wt %) on the first conductor layer 211 side is calculated by performing EDX analysis with a scanning transmission electron microscope (STEM). Regarding the pretreatment, for example, a wiring having the first conductor layer 211 and the second conductor layer 212 may be exposed on a cross section by polishing or milling, and the cross section may thinly be etched by dry etching with Ar or wet etching with nitric acid so that the boundary between the first conductor layer 211 and the second conductor layer 212 thereby becomes clearer due to a difference in etching rate. However, regardless of the presence/absence of the pretreatment, the first conductor layer 211 may be determined from a continuity and a particle size of particles by STEM. The EDX analysis may be performed by using, for example, JEM-2200FS manufactured by JEOL as STEM and Noran System 7 manufactured by Thermo Fisher Scientific as an EDX system at the magnification of 400 k (magnification of 400 k or more as needed).

Figure 2A:
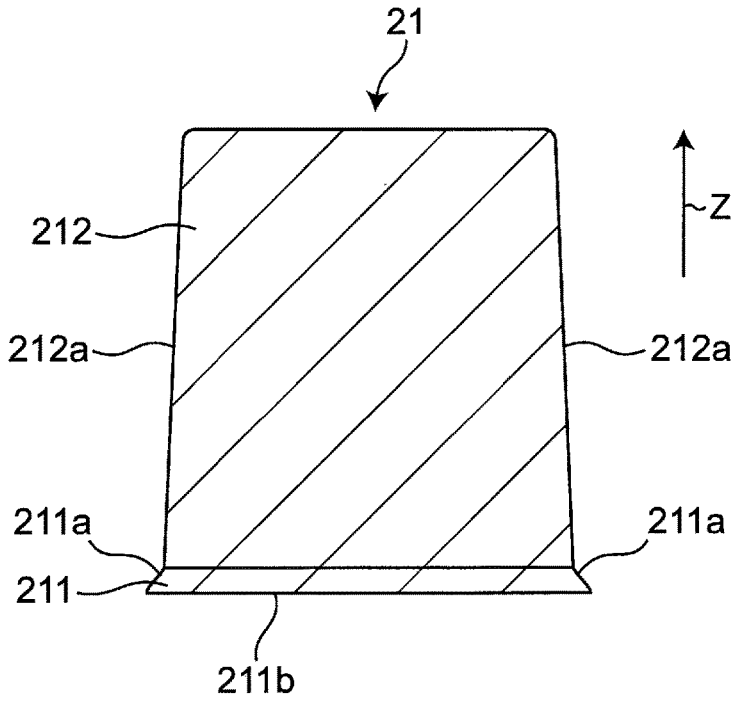
FIG. 2A is an enlarged cross-sectional view of a spiral wiring.

FIG. 2A is an enlarged cross-sectional view of the spiral wiring 21. As shown in FIG. 2A, the line width of the first conductor layer 211 is different from the line width of the second conductor layer 212. The line width of the first conductor layer 211 refers to the maximum value of the width of the first conductor layer 211, and the line width of the second conductor layer 212 refers to the maximum value of the width of the second conductor layer 212. As a result, a combination of formation methods of conductor layers forming various shapes can be employed, which increases a degree of design freedom of the spiral wiring 21.

Specifically, as shown in FIG. 2A, the line width of the first conductor layer 211 is larger than the line width of the second conductor layer 212. As a result, the spiral wiring 21 has a forward tapered shape widened on the bottom side and narrowed on the top side, so that the second magnetic layer 12 is easily filled in the vicinity of the side surfaces of the spiral wiring 21.

As shown in FIG. 2A, a taper angle of a side surface 211*a* of the first conductor layer 211 is larger than a taper angle of a side surface 212*a* of the second conductor layer 212. The side surface 211*a* of the first conductor layer 211 refers to a surface in the width direction of the first conductor layer 2121, and the side surface 212*a* of the second conductor layer 212 refers to a surface in the width direction of the second conductor layer 212. As a result, the spiral wiring 21 has a forward tapered shape widened on the bottom side and narrowed on the top side, so that the second magnetic layer 12 can easily be filled in the vicinity of the side surfaces of the spiral wiring 21.

For example, the taper angle of the side surface 211*a* of the first conductor layer 211 is 30.0°, and the taper angle of the side surface 212*a* of the second conductor layer 212 is 1.2°. In this case, based on the Z direction (0°), the angle is positive when a taper shape is formed, and the angle is negative when a reverse taper shape is formed. The taper angle may accurately be measured in a region of 80% excluding upper/lower 20% of the thickness of each of the first conductor layer 211 and the second conductor layer 212.

The present disclosure is not limited to the relationships of the line width and the taper angle of FIG. 2A and, for example, the line width or the taper angle of the first conductor layer 211 may be smaller than the line width or taper angle of the second conductor layer 212.

Figure 2B:
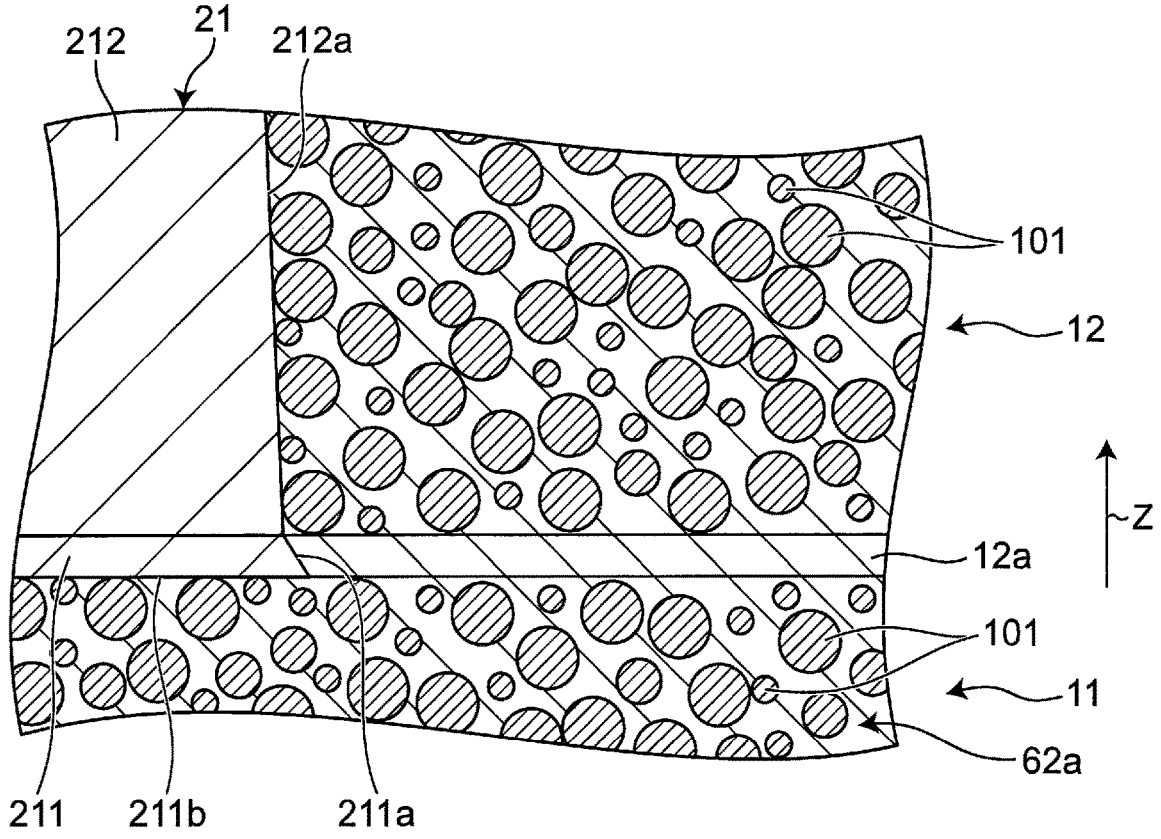
FIG. 2B is an enlarged cross-sectional view of a contact portion between the spiral wiring and a magnetic layer.

FIG. 2B is an enlarged cross-sectional view of the spiral wiring 21 and the magnetic layers 11, 12. As shown in FIG. 2B, a magnetic powder 101 of the second magnetic layer 12 is in contact with the side surface of the spiral wiring 21 (in this embodiment, mainly the side surface 212*a* of the second conductor layer 212). As a result, a filling amount of the magnetic powder 101 into the second magnetic layer 12 can be increased, and the inductance can be improved.

The magnetic powder 101 of the first magnetic layer 11 is in contact with a bottom surface 211*b* of the spiral wiring 21 (in this embodiment, the bottom surface 211*b* of the first conductor layer 211). As a result, a filling amount of the magnetic powder 101 into the first magnetic layer 11 can be increased, and the inductance can be improved.

The density of the magnetic powder 101 is different between a portion of the first magnetic layer 11 (the magnetic resin layer 62*a*) in contact with the bottom surface 211*b* of the first conductor layer 211 and a portion of the second magnetic layer 12 in contact with the side surface 211*a* of the first conductor layer 211. As a result, a degree of design freedom of the inductor component including the insulation and inductance of the spiral wiring 21 is increased due to the density of the magnetic powder 101.

For example, the density of the magnetic powder 101 in the portion of the first magnetic layer 11 (the magnetic resin layer 62*a*) in contact with the bottom surface 211*b* of the first conductor layer 211 may be higher than the density of the magnetic powder 101 in the portion of the second magnetic layer 12 in contact with the side surface 211*a* of the first conductor layer 211. As a result, the effective magnetic permeability is improved on the bottom surface 211*b* side of the first conductor layer 211, and the insulation is improved on the side surface 211*a* side of the first conductor layer 211.

In this case, the second magnetic layer 12 has a resin layer 12*a* in a portion in contact with the first magnetic layer 11. The resin layer 12*a* is a region having a smaller amount of the magnetic powder (inorganic filler) 101 as compared to the first magnetic layer 11 and the portion of the second magnetic layer 12 other than the resin layer 12*a*. The resin layer 12*a* may not contain the magnetic powder or may contain the magnetic powder as long as the amount of the magnetic powder present therein is smaller as compared to the first magnetic layer 11 and the portion of the second magnetic layer 12 other than the resin layer 12*a*.

Since the second magnetic layer 12 has the resin layer 12*a* in a portion in contact with the first magnetic layer 11, the adhesion is improved between the first magnetic layer 11 and the second magnetic layer 12, and the magnetic layers 11, 12 of the inductor component 1 can be improved in strength. Additionally, since the resin layer 12*a* having a smaller amount of magnetic powder is disposed, magnetic saturation characteristics can be improved.

The thickness of the resin layer 12*a* is the same as the thickness of the first conductor layer 211. The thickness of the resin layer 12*a* is preferably 0.5 μm or more and 30 μm or less (i.e., from 0.5 μm to 30 μm). When the thickness of the resin layer 12*a* is 0.5 μm or more, the adhesion can further be improved between the first magnetic layer 11 and the second magnetic layer 12, and the magnetic saturation characteristics can further be improved. When the thickness of the resin layer 12*a* is 30 μm or less, the adhesion and the magnetic saturation characteristics are improved, and a decrease in acquisition efficiency of the inductance can be suppressed at the same time.

A method of confirming the resin layer 12*a* can be as follows. First, cross-section polishing is performed in a direction in which the width and thickness of the spiral wiring 21 are known, and surface milling or acid wet treatment is performed. As a result, a boundary between the first conductor layer 211 and the second conductor layer 212 is emphasized due to a difference in unevenness and a difference in etching rate. A stereomicroscope or a scanning electron microscope (SEM) is then used for acquiring an image of the first magnetic layer 11 under the bottom surface 211*b* of the first conductor layer 211 and an image of the magnetic layer (the resin layer 12*a*) adjacent to the first conductor layer 211 at the same magnification (for example, 2000 times). In this case, the two regions may be included in one image. Subsequently, after the magnetic powder and the resin are distinguished by an image process such as a binarization process, the two regions are scanned at substantially the same width and the same thickness as the first conductor layer 211 to calculate the proportions of the magnetic powder and the resin for comparing the amount of the magnetic powder present therein, and the resin layer 12*a* can thereby be confirmed.

In the inductor component 1, the magnetic resin layer 62*a* on an upper surface of the substrate 61 may not be included, and in this case, the spiral wiring 21 is disposed on the substrate 61 of the first magnetic layer 11. The substrate 61 may not be included, and in this case, the spiral wiring 21 is disposed on the magnetic resin layer 62*b* of the first magnetic layer 11.

A columnar wiring may be disposed such that the wiring is led out from the spiral wiring 21 to the bottom surface of the inductor component 1. In this case, an external terminal connected to the columnar wiring may be disposed on the bottom surface of the inductor component 1. This can improve a degree of freedom of connection between the inductor component 1 and another circuit component.

Although the inductor component 1 has the one spiral wiring 21, the present disclosure is not limited to this configuration, and a second spiral wiring adjacent to the spiral wiring 21 may be included on the same plane as the spiral wiring 21. As a result, for example, the inductance can be improved by an inductor array in which the spiral wiring 21 and the second spiral wiring are electrically separated or by the spiral wiring 21 and the second spiral wiring connected in series. Alternatively, the spiral wiring 21 and the second spiral wiring may be connected in parallel to achieve a reduction in Rdc. The term "adjacent" means that, when multiple spiral wirings exist, the spiral wirings face each other without another spiral wiring interposed therebetween and does not mean that the spiral wirings are in direct contact with each other.

(Manufacturing Method)

A manufacturing method of the inductor component 1 will be described.

Figure 3A:
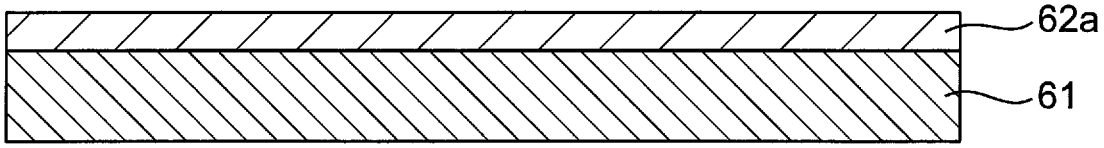
FIG. 3A is an explanatory view for explaining a manufacturing method of the inductor component according to the first embodiment.

As shown in FIG. 3A, a substrate 61 is prepared. For example, the substrate 61 is a flat plate-shaped magnetic substrate made up of a sintered body such as NiZn- or MnZn-based ferrite. Since the thickness of the substrate 61 does not affect the thickness of the inductor component, the substrate with easy-to-handle thickness may appropriately be used for the reason of warpage due to processing etc. A magnetic sheet 67 made of a magnetic material is pressure-bonded to the upper surface of the substrate 61. As a result, the magnetic resin layer 62*a* of the first magnetic layer 11 is formed on the upper surface of the substrate 61.

Figure 3B:
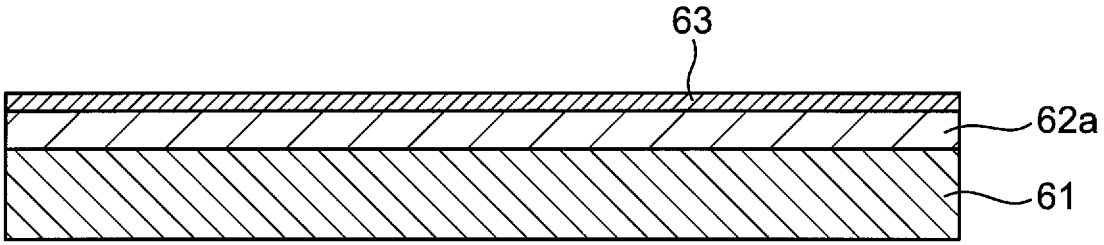
FIG. 3B is an explanatory view for explaining a manufacturing method of the inductor component according to the first embodiment.

As shown in FIG. 3B, a seed layer 63 of copper foil is formed by pressure bonding etc. on the magnetic resin layer 62*a* of the first magnetic layer 11. The seed layer 63 of copper foil may be the seed layer 63 of copper foil already formed on one surface of the magnetic sheet 67 or may be formed by pressure-bonding thereof to the upper surface of the substrate 61. The seed layer 63 constitutes the first conductor layer 211 of the spiral wiring 21. The thickness of the seed layer 63 is, for example, 1.5 μm or more and 2.0 μm or less (i.e., from 1.5 μm to 2.0 μm). As described above, since the seed layer 63 of copper foil is used without using electroless plating, the magnetic resin layer 62*a* of the first magnetic layer 11 is not damaged and the magnetic powder is not removed. Therefore, the magnetic resin layer 62*a* immediately below the seed layer 63 has substantially the same amount of the magnetic powder as in the state of the magnetic sheet 67. This means that no substantial difference exists in the content of the magnetic powder between the upper surface (seed layer 63) side and the bottom surface (substrate 61) side of the magnetic resin layer 62*a*.

In contrast, if a seed layer of electroless plating is used instead of the seed layer 63 of copper foil, it is necessary to perform a pretreatment of electroless plating, and the magnetic resin layer 62*a* is damaged by alkali or acid. Therefore, in the magnetic resin layer 62*a* immediately below the electroless plating, no magnetic powder is present at a predetermined thickness or an amount of the magnetic powder is reduced as compared to the state of the magnetic sheet 67. This means that the content of the magnetic powder is explicitly smaller on the upper surface (seed layer 63) side of the magnetic resin layer 62*a* than the bottom surface (substrate 61) side.

Figure 3C:
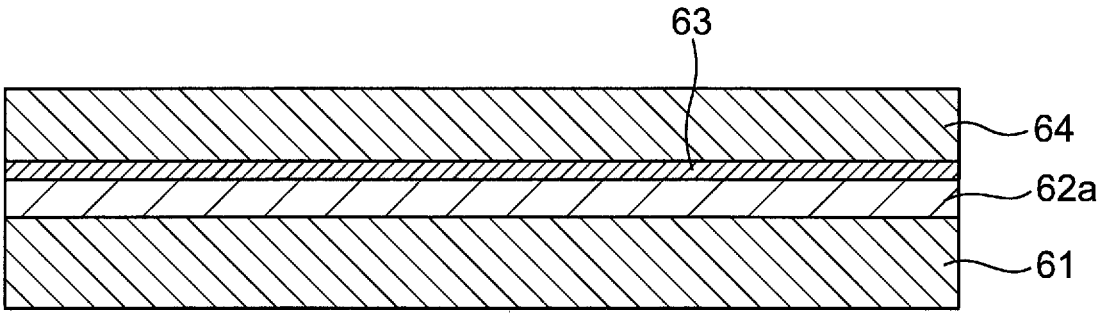
FIG. 3C is an explanatory view for explaining a manufacturing method of the inductor component according to the first embodiment.
Figure 3D:
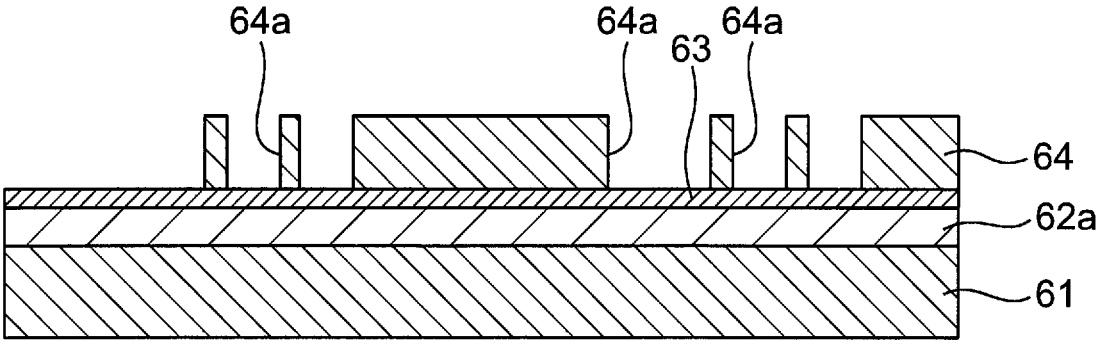
FIG. 3D is an explanatory view for explaining a manufacturing method of the inductor component according to the first embodiment.

As shown in FIG. 3C, a dry film resist (DFR) 64 is affixed onto the seed layer 63. As shown in FIG. 3D, the DFR 64 is patterned by photolithography to form a through-hole 64*a* in a region for forming the spiral wiring 21, so that the seed layer 63 is exposed from the through-hole 64*a*.

Figure 3E:
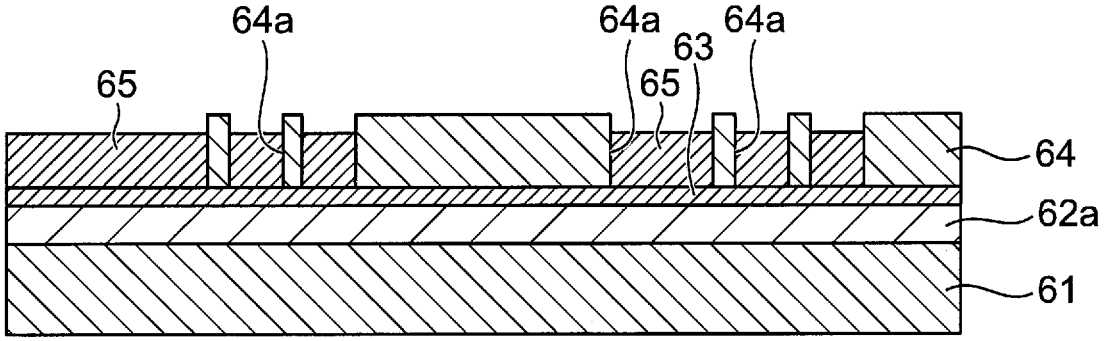
FIG. 3E is an explanatory view for explaining a manufacturing method of the inductor component according to the first embodiment.
Figure 3F:
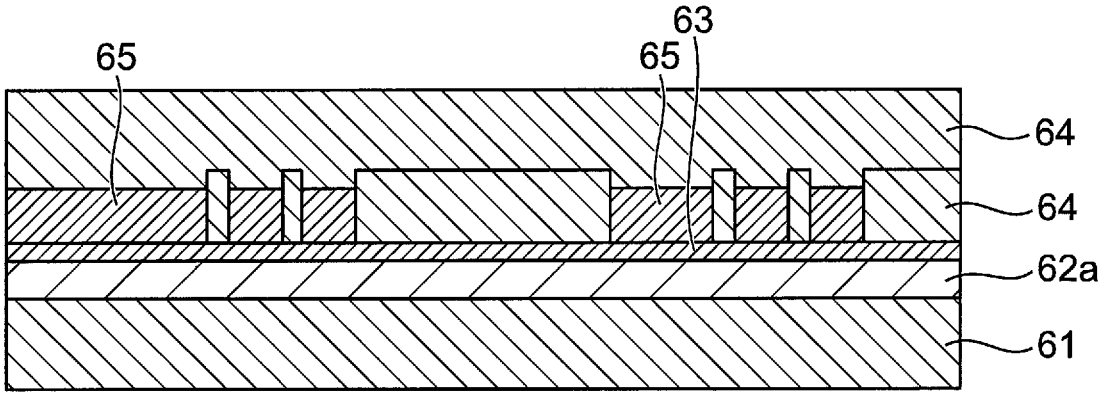
FIG. 3F is an explanatory view for explaining a manufacturing method of the inductor component according to the first embodiment.

As shown in FIG. 3E, a metal film 65 is formed on the seed layer 63 in the through-hole 64*a* by electroplating. The metal film 65 constitutes the second conductor layer 212 of the spiral wiring 21. As shown in FIG. 3F, after formation of the metal film 65, the DFR 64 is further affixed.

Figure 3G:
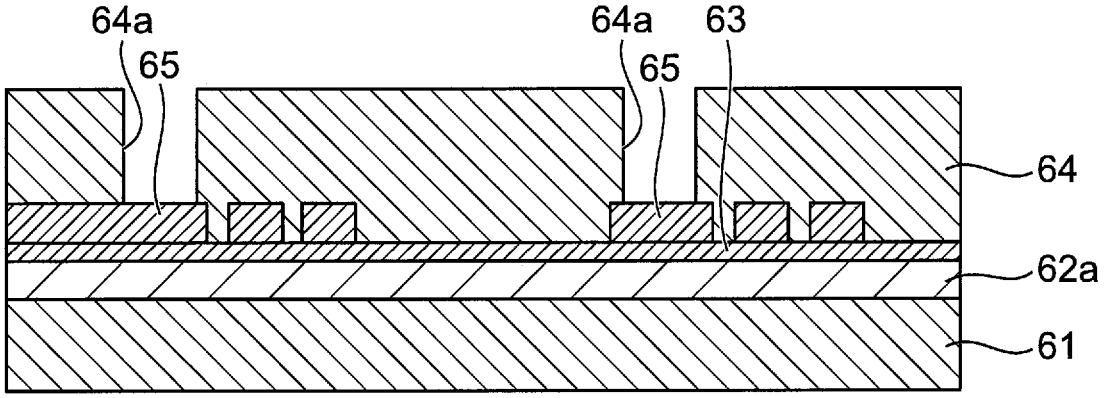
FIG. 3G is an explanatory view for explaining a manufacturing method of the inductor component according to the first embodiment.
Figure 3H:
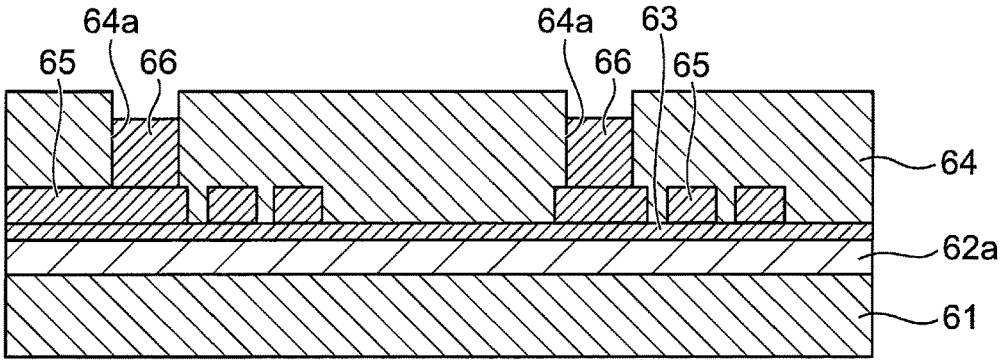
FIG. 3H is an explanatory view for explaining a manufacturing method of the inductor component according to the first embodiment.

As shown in FIG. 3G, the DFR 64 is patterned by photolithography, and the through-hole 64*a* is formed in a region for forming the columnar wiring, so that the metal film 65 is exposed from the through-hole 64*a*. As shown in FIG. 3H, a metal film 66 is further formed by electrolytic plating on the metal film 65 in the through-hole 64*a*.

Figure 3I:
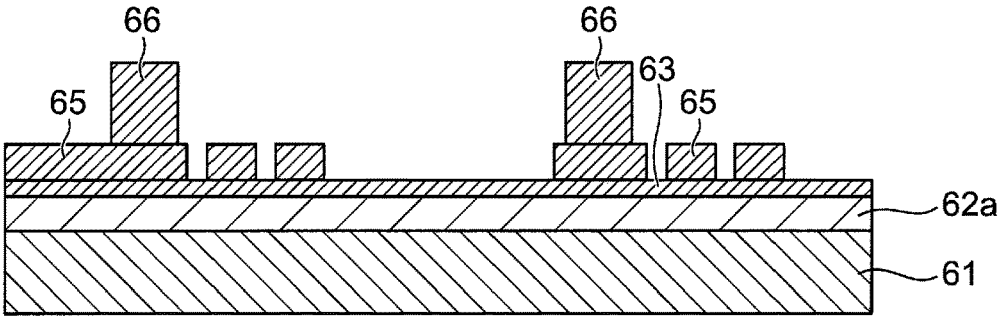
FIG. 3I is an explanatory view for explaining a manufacturing method of the inductor component according to the first embodiment.
Figure 3J:
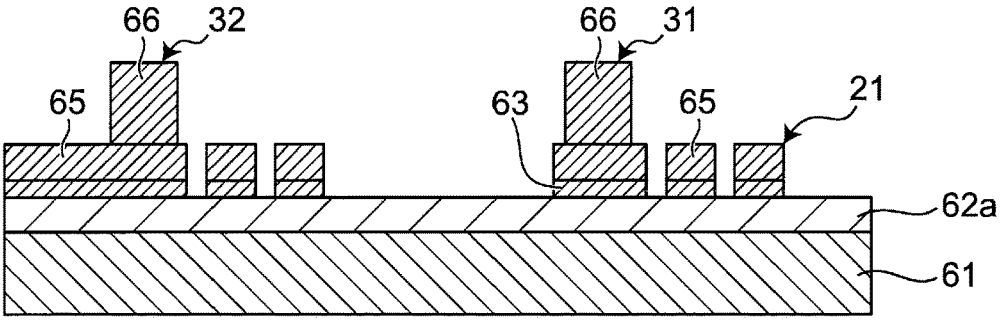
FIG. 3J is an explanatory view for explaining a manufacturing method of the inductor component according to the first embodiment.

As shown in FIG. 3I, the DFK 64 is removed, and as shown in FIG. 3J, the seed layer 63 is removed by etching in an exposed portion on which the metal film 65 is not formed. As a result, the spiral wiring 21 is formed on the upper surface of the magnetic resin layer 62*a*. Therefore, the spiral wiring 21 has the seed layer 63 as the first conductor layer 211 and the metal film 65 as the second conductor layer 212. The metal film 65 has a spiral shape along the seed layer 63. The columnar wirings 31, 32 extending from the spiral wiring 21 in the normal direction are formed. Therefore, the columnar wirings 31, 32 are formed after formation of the spiral wiring 21 and before formation of the magnetic layer.

For a method of disposing the resin layer 12*a* between the first magnetic layer 11 and the second magnetic layer 12, an acid wet treatment may be performed at the time of etching of the seed layer 63 or after the etching so as to dissolve the magnetic powder, or a resin component in the magnetic layer may be dissolved by an alkali wet treatment to remove particles of the magnetic powder.

Figure 3K:
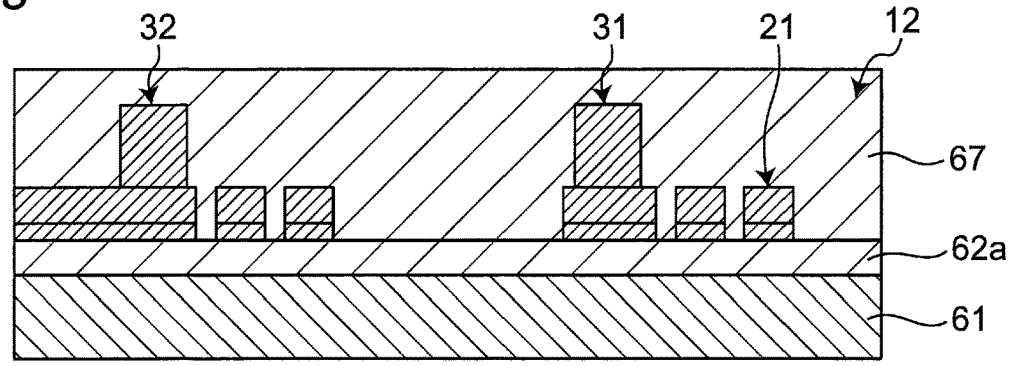
FIG. 3K is an explanatory view for explaining a manufacturing method of the inductor component according to the first embodiment.

As shown in FIG. 3K, the magnetic sheet 67 made of a magnetic material is pressure-bonded to the upper-surface side (spiral wiring formation side) of the magnetic resin layer 62*a*. As a result, the second magnetic layer 12 is formed on the magnetic resin layer 62*a* in contact with at least a portion of the spiral wiring 21 (the side surface of the spiral wiring 21 and the upper surface of the spiral wiring 21 except the portions in contact with the columnar wiring 31, 32).

Figure 3L:
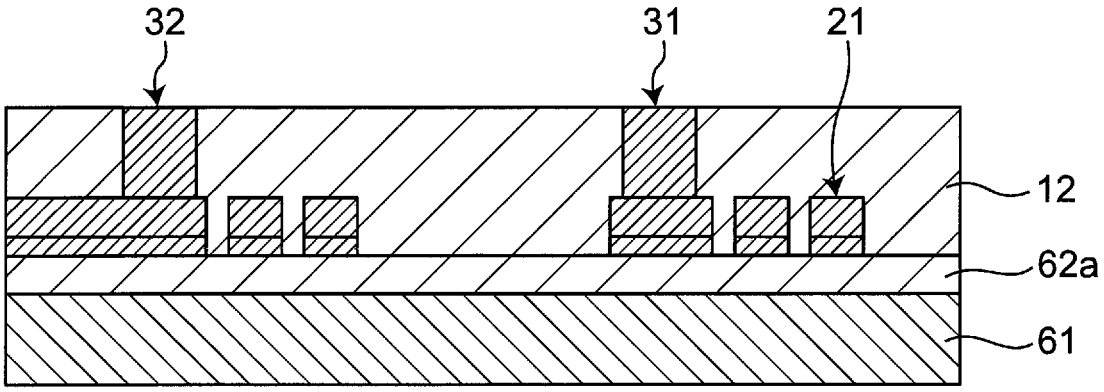
FIG. 3L is an explanatory view for explaining a manufacturing method of the inductor component according to the first embodiment.
Figure 3M:
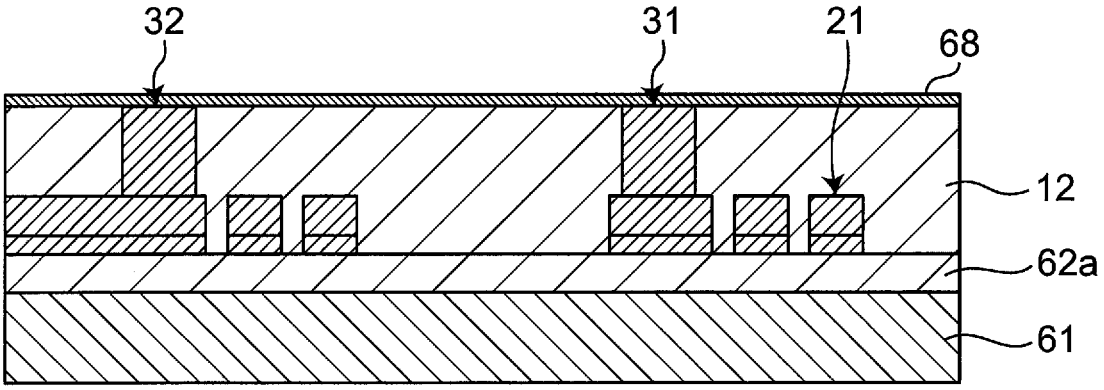
FIG. 3M is an explanatory view for explaining a manufacturing method of the inductor component according to the first embodiment.

As shown in FIG. 3L, the second magnetic sheet 12 is polished to expose the upper ends of the columnar wirings 31, 32 (the metal film 66). As shown in FIG. 3M, a solder resist (SR) 68 is formed as the coating film 50 on the upper surface of the second magnetic sheet 12.

Figure 3N:
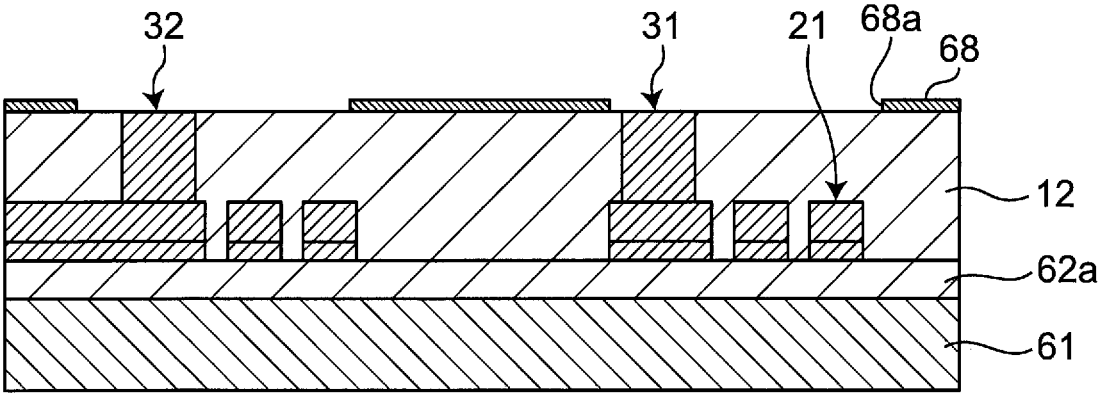
FIG. 3N is an explanatory view for explaining a manufacturing method of the inductor component according to the first embodiment.

As shown in FIG. 3N, the SR 68 is patterned by photolithography to form through-holes 68*a* through which the columnar wirings 31, 32 (the metal film 66) and the second magnetic layer 12 (the magnetic sheet 67) are exposed, in a region for forming external terminals.

Figure 3O:
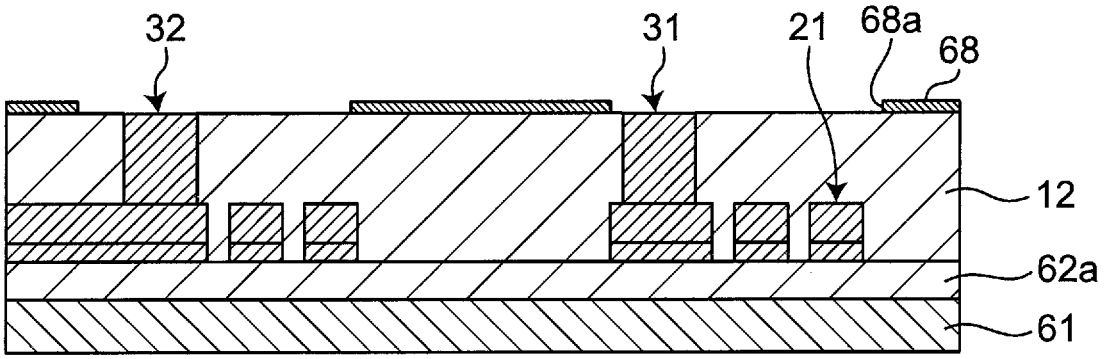
FIG. 3O is an explanatory view for explaining a manufacturing method of the inductor component according to the first embodiment.
Figure 3P:
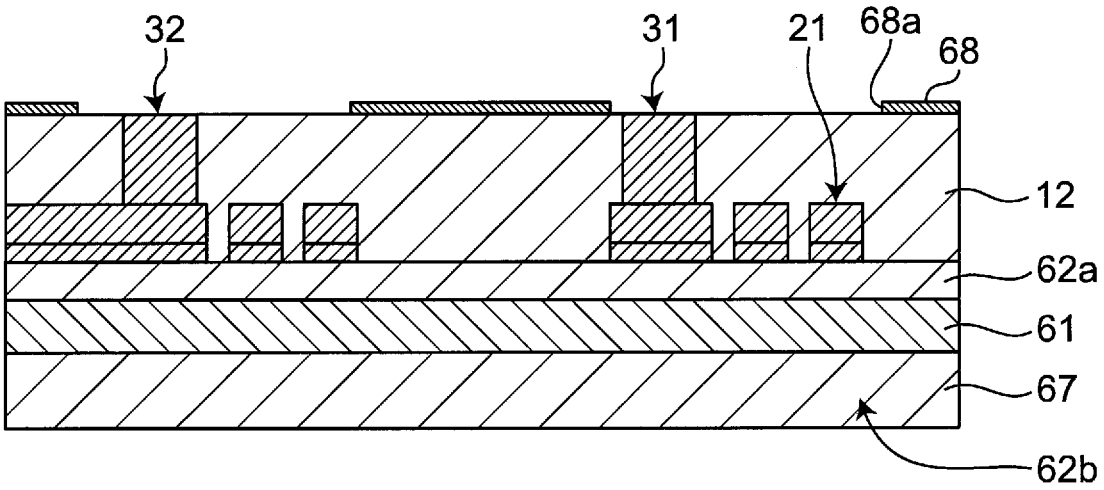
FIG. 3P is an explanatory view for explaining a manufacturing method of the inductor component according to the first embodiment.

As shown in FIG. 3O, the substrate 61 is polished from the first principal surface 61*a* side opposite to the magnetic resin layer 62*a*. In this case, the substrate 61 is not completely removed and is partially left. As shown in FIG. 3P, the magnetic sheet 67 made of a magnetic material is pressure-bonded to the first principal surface 61*a* on the polished side of the substrate 61 and is polished to an appropriate thickness. As a result, the magnetic resin layer 62*b* of the first magnetic layer 11 is formed in close contact with the first principal surface 61*a* of the substrate 61.

Figure 3Q:
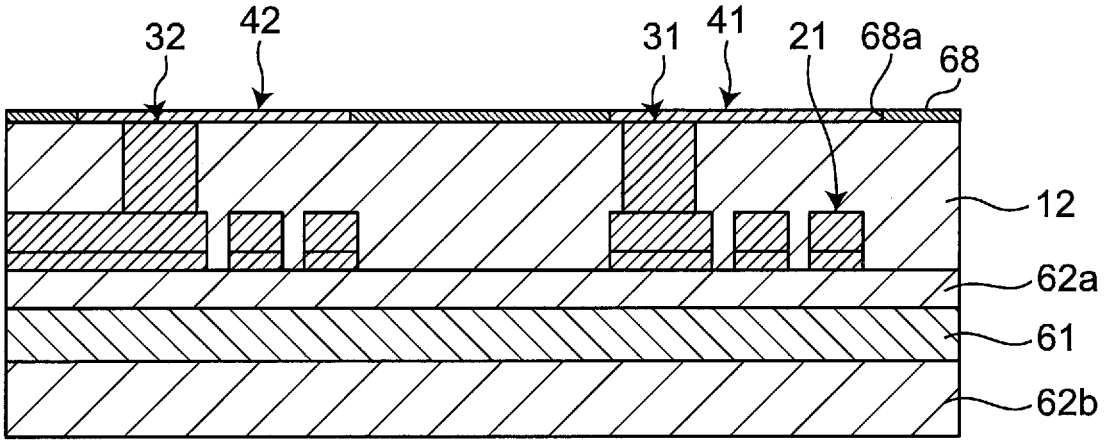
FIG. 3Q is an explanatory view for explaining a manufacturing method of the inductor component according to the first embodiment.
Figure 3R:
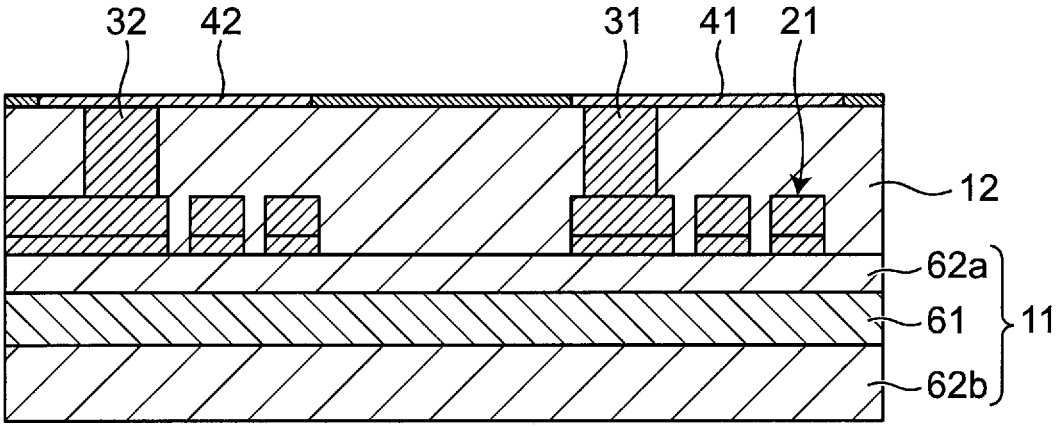
FIG. 3R is an explanatory view for explaining a manufacturing method of the inductor component according to the first embodiment.

As shown in FIG. 3Q, a metal film 69 of Cu/Ni/Au is formed by electroless plating and grown from the columnar wirings 31, 32 into the through-holes 68*a* of the SR 68. The metal film 69 forms the first external terminal 41 connected to the first columnar wiring 31 and the second external terminal 42 connected to the second columnar wiring 32. As shown in FIG. 3R, individual pieces are formed and subjected to barrel polishing as needed, and burrs are removed to manufacture the inductor component 1.

The manufacturing method of the inductor component 1 is merely an example, and techniques and materials used in steps may appropriately be replaced with other known techniques and materials. For example, although the DFR 64 and the SR 68 are patterned after coating in the above description, the DFR 64 and the SR 68 may directly be formed on necessary portions by application, printing, mask vapor deposition, lift-off, etc. Although polishing is used for removal of the substrate 61 and thinning of the magnetic sheet 67, another physical process such as blasting and laser or a chemical process such as hydrofluoric acid treatment may be used. Alternatively, all of the substrate 61 may be removed.

Second Embodiment

Figure 4A:
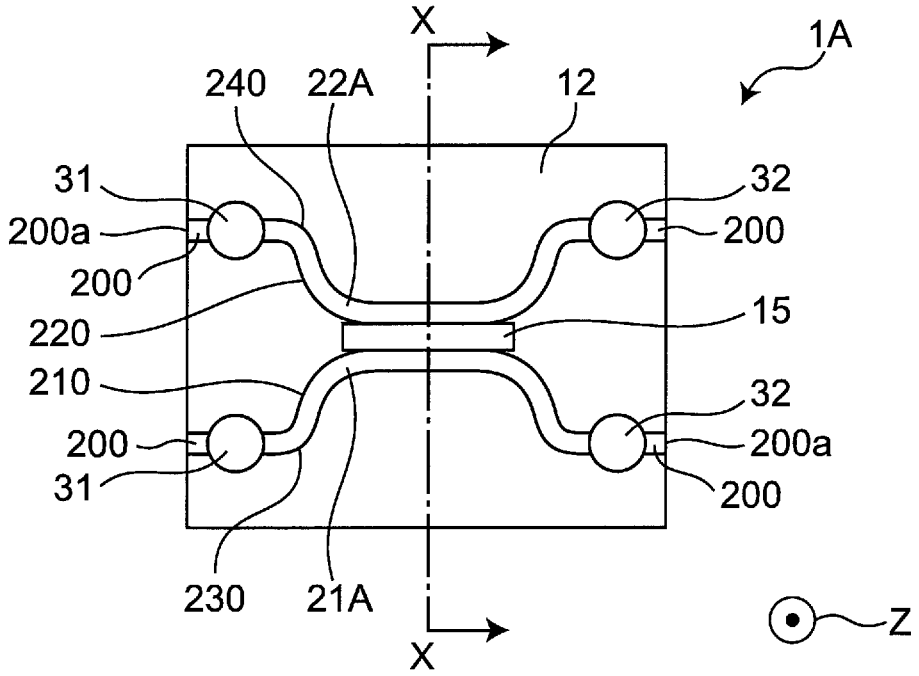
FIG. 4A is a transparent plan view showing an inductor component according to a second embodiment.
Figure 4B:
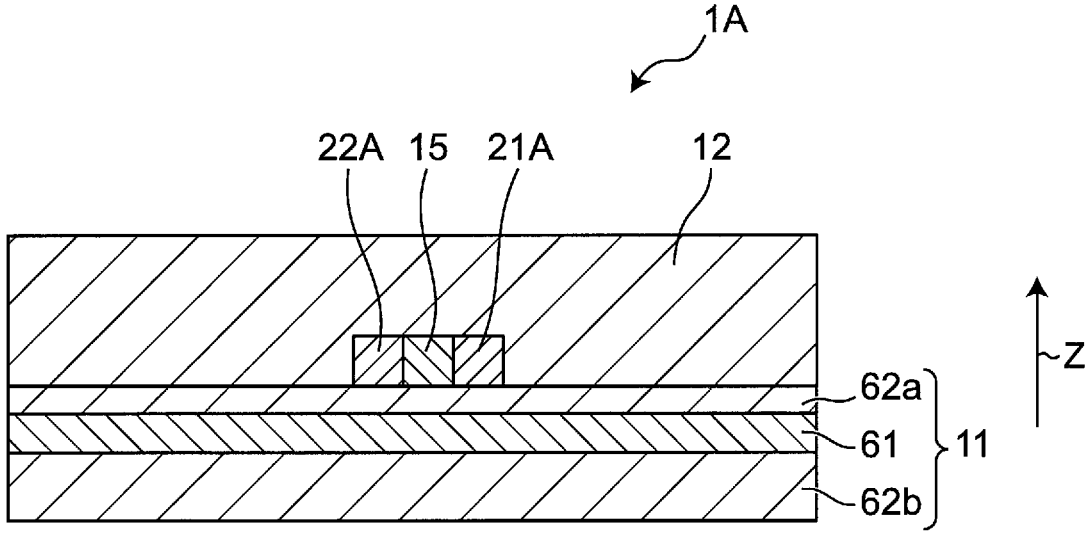
FIG. 4B is a cross-sectional view taken along a line X-X of FIG. 4A.

FIG. 4A is a transparent perspective view showing a second embodiment of an inductor component. FIG. 4B is a cross-sectional view taken along a line X-X of FIG. 4A. The second embodiment is different from the first embodiment in the configuration of the spiral wiring. This different configuration will hereinafter be described. In the second embodiment, the same constituent elements as the first embodiment are denoted by the same reference numerals as the other embodiment and therefore will not be described.

As shown in FIGS. 4A and 4B, unlike the inductor component 1 of the first embodiment, an inductor component 1A of the second embodiment includes a first spiral wiring 21A and a second spiral wiring 22A adjacent to the first spiral wiring 21A on the same plane as the first spiral wiring 21A. In the inductor component 1A, the first spiral wiring 21A and the second spiral wiring 21B are electrically separated, so that an inductor array can be achieved.

The first and second spiral wirings 21A, 22A are wound into a planar shape. Specifically, the first and second spiral wirings 21A, 22A have a semi-elliptical arc shape when viewed in the Z direction. Therefore, each of the first and second spiral wirings 21A, 22A is a curved wiring wound around about a half of the circumference. The first and second spiral wirings 21A, 22A each include a linear part in a middle portion.

The first and second spiral wirings 21A, 22A each have both ends connected to the first columnar wiring 31 and the second columnar wiring 32 located on the outer side and have a curved shape drawing an arc from the first columnar wiring 31 and the second columnar wiring 32 toward the center side of the inductor component 1A.

It is assumed that an inner diameter portion of each of the first and second spiral wirings 21A, 22A is defined as an area surrounded by the curve drawn by the first and second spiral wirings 21, 22 and the straight line connecting both ends of the first and second spiral wirings 21A, 22A. In this case, neither of the first and second spiral wirings 21A, 22A have the inner diameter portions overlapping with each other when viewed in the Z direction.

On the other hand, the first and second spiral wirings 21A, 22A are close to each other in respective arc portions. Therefore, the magnetic flux generated in the first spiral wiring 21A goes around the adjacent second spiral wiring 22A, and the magnetic flux generated in the second spiral wiring 22A goes around the adjacent first spiral wiring 21A. Thus, the first spiral wiring 21A and the second spiral wiring 22A are magnetically coupled.

As shown in FIG. 4A, the first and second spiral wirings 21A, 22A have wirings further extending toward the outside of the chip from connecting positions for the columnar wirings 31, 32, and these wirings are exposed to the outside of the chip. Therefore, the first and second spiral wirings 21A, 22A have exposed portions 200 exposed to the outside from side surfaces parallel to the lamination direction (Z direction) of the inductor component 1A.

The exposed portions 200 are connected to a power feeding wiring when additional electrolytic plating is performed after the metal film 65 is formed by electrolytic plating in the same manufacturing method as FIGS. 3A to 3R. Even after the seed layer 63 is removed, additional electrolytic plating can easily be performed with the power feeding wiring, and an inter-wiring distance can be narrowed between the spiral wirings made up of the seed layer 63 and the metal film 65. Specifically, in the inductor component 1A, the inter-wiring distance between the first and second spiral wirings 21A, 22A can be narrowed by performing the additional electrolytic plating, so that the magnetic coupling can be enhanced.

Since the spiral wirings 21A, 22A have the exposed portions 200, a resistance to electrostatic destruction can be improved at the time of manufacturing. Specifically, in the method of manufacturing the inductor component 1, the exposed portions 200 are connected to a plurality of inductor components through the power feeding wiring before singulation. Therefore, even if static electricity is applied to the wirings in this state, the static electricity can be dispersed through the power feeding wiring and discharged to the ground, so that the resistance to electrostatic destruction can be improved.

In the spiral wirings 21A, 22A, a thickness of an exposed surface 200*a* of the exposed portion 200 is preferably equal to or less than the thickness of the spiral wirings 21A, 22A and is 45 urn or more. As a result, since the thickness of the exposed surface 200*a* is equal to or less than the thickness of the spiral wirings 21A, 22A, the proportion of the magnetic layers 11, 12 can be increased, and the inductance can be improved. As long as the thickness of the exposed surface 200*a* of the exposed portion 200 is equal to or less than at least one of the first spiral wiring 21A and the second spiral wiring 22A, the proportion of the magnetic layer 11 can be increased, and the inductance can be improved. Additionally, since the thickness of the exposed surface 200*a* is 45 urn or more, occurrence of disconnection can be reduced. Preferably, the exposed surface 200*a* is an oxide film. As a result, a short circuit can be suppressed between the inductor component 1A and an adjacent component.

An insulating layer 15 is disposed between the spiral wiring 21A and the spiral wiring 22A adjacent thereto. The insulating layer 15 is a film-shaped layer formed on the magnetic resin layer 62*a* on the second principal surface 61*b* of the substrate 61. The insulating layer 15 is made of an insulating material containing no magnetic substance and is made of a resin material containing at least one of an epoxy resin, a polyimide resin, a phenol resin, and a vinyl ether resin, for example. The insulating layer 15 may contain a filler of a nonmagnetic substance such as silica and, in this case, the insulating layer 15 can be improved in the strength, workability, and electrical characteristics.

The insulating layer 15 is disposed at a position including a region in which a distance is minimum between the spiral wirings 21A, 22A adjacent to each other. Specifically, in the inductor component 1A, the insulating layer 15 is disposed at a position including a region in which the arc portions of the adjacent spiral wirings 21A, 22A become closest to each other. Therefore, the insulating layer 15 is disposed in the region most likely to cause a problem of insulation where the distance is minimum between the spiral wirings 21A, 22A, so that the insulation can further be improved between the first and second spiral wirings 21A, 22A adjacent to each other.

The spiral wirings 21A, 22A adjacent to each other have first side surfaces 210, 220 facing each other. The insulating layer 15 is in contact with a portion of the first side surface 210 of the spiral wiring 21A and a portion of the first side surface 220 of the spiral wiring 22A. Therefore, the insulating layer 15 is in contact with the first side surfaces 210, 220 of the arc portions of the spiral wirings 21A, 22A. As a result, the width of the insulating layer 15 disposed between the spiral wirings 21A, 22A can be ensured larger, and the insulation can further be maintained.

At least portions of the first side surfaces 210, 220 are in contact with the second magnetic layer 12. As a result, since at least portions of the first side surfaces 210, 220 are in contact with the second magnetic layer 12 between the spiral wirings 21A, 22A improved in insulation due to the insulating layer 15 disposed therebetween, the region of the magnetic layer is increased, so that the inductance can effectively be improved while the insulation is ensured.

The spiral wirings 21A, 22A have second side surfaces 230, 240 on the side opposite to the first side surfaces 210, 220, respectively, and the second side surfaces 230, 240 are in contact with the second magnetic layer 12. As a result, since the region of the magnetic layer is increased on the side of the second side surfaces 230, 240 not affecting the insulation between the spiral wirings 21A, 22A, the inductance can more effectively be improved. Particularly, in the inductor component 1, the second side surfaces 230, 240 are entirely in contact with the second magnetic layer 12, and the effect of improving the inductance can be exerted to the maximum.

The present disclosure is not limited to the embodiments described above and may be changed in design without departing from the spirit of the present disclosure. For example, respective feature points of the first and second embodiments may variously be combined.

In the embodiments, an upper spiral wiring may be located above a spiral wiring, and the lower spiral wiring and the upper spiral wiring may electrically be connected in parallel by a via conductor not shown. This can substantially increase the wiring cross-sectional area in the same current path, so that Rdc can be reduced. In this case, an interlayer insulating layer may further be included between the lower spiral wiring and the upper spiral wiring.

What is claimed is:

1. An inductor component comprising:

a first magnetic layer;

a spiral wiring disposed on the first magnetic layer; and a second magnetic layer covering the spiral wiring, wherein the first magnetic layer and the second magnetic layer contain a magnetic powder and a resin containing the magnetic powder, the spiral wiring includes a spiral-shaped first conductor layer and a second conductor layer disposed on the first conductor layer and shaped along the first conductor layer, and a density of the magnetic powder is different between a first portion of the second magnetic layer in contact with a side surface of the first conductor layer and a second portion of the second magnetic layer in contact with a side surface of the second conductor layer.

2. The inductor component according to claim 1, wherein the thickness of the second conductor layer is larger than the thickness of the first conductor layer.

3. The inductor component according to claim 1, wherein a main material of the first conductor layer and the second conductor layer is Cu or an alloy containing Cu.

4. The inductor component according to claim 1, wherein a difference between the electric conductivity of the first conductor layer and the electric conductivity of the second conductor layer is 5% or less.

5. The inductor component according to claim 1, wherein the first conductor layer has a thickness of 0.5 μm or more.

6. The inductor component according to claim 1, wherein the Ni content percentages of the first conductor layer and the second conductor layer are substantially the same.

7. The inductor component according to claim 1, wherein the first conductor layer has a Ni content percentage of 5.0 wt % or less.

8. The inductor component according to claim 1, wherein the line width of the first conductor layer is different from the line width of the second conductor layer.

9. The inductor component according to claim 1, wherein the line width of the first conductor layer is larger than the line width of the second conductor layer.

10. The inductor component according to claim 1, wherein a taper angle of the side surface of the first conductor layer is larger than a taper angle of the side surface of the second conductor layer.

11. The inductor component according to claim 1, wherein the density of the magnetic powder is different between a portion of the first magnetic layer in contact with a bottom surface of the first conductor layer and the first portion of the second magnetic layer in contact with the side surface of the first conductor layer.

12. The inductor component according to claim 1, wherein the density of the magnetic powder in a portion of the first magnetic layer in contact with a bottom surface of the first conductor layer is higher than the density of the magnetic powder in the first portion of the second magnetic layer in contact with the side surface of the first conductor layer.

13. The inductor component according to claim 1, wherein the magnetic powder is in contact with a side surface of the spiral wiring.

14. The inductor component according to claim 1, wherein the magnetic powder is in contact with a bottom surface of the spiral wiring.

15. The inductor component according to claim 1, further comprising a second spiral wiring adjacent to the spiral wiring on the same plane as the spiral wiring.

16. The inductor component according to claim 1, further comprising an insulating layer disposed between the spiral wiring and a second spiral wiring and containing no magnetic substance, wherein the spiral wiring includes a first side surface facing the second spiral wiring, and the first side surface is at least partially in contact with the second magnetic layer.

17. The inductor component according to claim 1, wherein the spiral wiring includes an exposed portion exposed to the outside from a side surface parallel to a lamination direction of the inductor component.

18. The inductor component according to claim 1, wherein the first magnetic layer includes a magnetic resin layer made of the magnetic powder and the resin, and a substrate that is a sintered body as well as a magnetic body having a first principal surface in close contact with the magnetic resin layer and a second principal surface, the second principal surface being disposed below the second magnetic layer, and wherein the spiral wiring is disposed between the second magnetic layer and the substrate.

19. The inductor component according to claim 18, wherein the thickness of the magnetic resin layer and the thickness of the second magnetic layer are both larger than the thickness of the substrate.

20. An inductor component comprising:

a first magnetic layer;

a spiral wiring disposed on the first magnetic layer; and a second magnetic layer covering the spiral wiring, wherein the first magnetic layer and the second magnetic layer contain a magnetic powder and a resin containing the magnetic powder, the spiral wiring includes a spiral-shaped first conductor layer and a second conductor layer disposed on the first conductor layer and shaped along the first conductor layer, a density of the magnetic powder in a portion of the first magnetic layer in contact with a bottom surface of the first conductor layer is higher than a density of the magnetic powder in a portion of the second magnetic layer in contact with a side surface of the first conductor layer, and the second magnetic layer directly contacts each of the first conductor layer and the second conductor layer.

* * * * *